US011578719B2

(12) United States Patent
Sunaga

(10) Patent No.: US 11,578,719 B2
(45) Date of Patent: Feb. 14, 2023

(54) PULSATION PHENOMENON SUPPRESSION MECHANISM OF PUMP DEVICE

(71) Applicant: HITACHI AUTOMOTIVE SYSTEMS, LTD., Hitachinaka (JP)

(72) Inventor: Yukichi Sunaga, Higashimatsuyama (JP)

(73) Assignee: HITACHI ASTEMO, LTD., Hitachinaka (JP)

( * ) Notice: Subject to any disclaimer, the term of this patent is extended or adjusted under 35 U.S.C. 154(b) by 216 days.

(21) Appl. No.: 16/646,303

(22) PCT Filed: Aug. 22, 2018

(86) PCT No.: PCT/JP2018/030900
§ 371 (c)(1),
(2) Date: Mar. 11, 2020

(87) PCT Pub. No.: WO2019/054139
PCT Pub. Date: Mar. 21, 2019

(65) Prior Publication Data

US 2020/0284254 A1 Sep. 10, 2020

(30) Foreign Application Priority Data

Sep. 13, 2017 (JP) ..... JP2017-175452

(51) Int. Cl.
*F04C 2/344* (2006.01)
*F04C 14/22* (2006.01)
(Continued)

(52) U.S. Cl.
CPC ..... *F04C 2/344* (2013.01); *F04C 14/223* (2013.01); *F04C 14/226* (2013.01);
(Continued)

(58) Field of Classification Search
CPC ..... F04C 2/344; F04C 14/223; F04C 14/226; F04C 15/0049; F04C 15/06; F04C 2/3442; F04C 29/06; F01C 21/108
See application file for complete search history.

(56) References Cited

U.S. PATENT DOCUMENTS 5,046,933 A 9/1991 Haga
6,280,150 B1 * 8/2001 Miyazawa ..... F04C 14/26 417/220

(Continued)

FOREIGN PATENT DOCUMENTS

JP 2-169883 A 6/1990
JP 2000-136781 A 5/2000
JP 2013-032739 A 2/2013

OTHER PUBLICATIONS

International Search Report with English translation issued in corresponding application No. PCT/JP2018/030900 dated Nov. 27, 2018.

(Continued)

*Primary Examiner* — Dominick L Plakkoottam
*Assistant Examiner* — Paul W Thiede
(74) *Attorney, Agent, or Firm* — Foley & Lardner LLP

(57) ABSTRACT

A first communication groove (38) extending from a start point of a discharge port (36) in a direction opposite to rotation direction of vanes (22) is formed. A first end portion (38E) of this groove is connected to the start point of the discharge port (36). When a front-side vane in a rotation direction of a driving shaft (11) is positioned at the start point of the discharge port (36), a second end portion (38S) of the groove is positioned at a rear side in the rotation direction with respect to a rear-side vane coming immediately after the front-side vane, and communicates with a suction port (35). A part of working fluid in a front-side pump chamber (27-1) can therefore be introduced into a (Continued)

rear-side pump chamber (27-2) that communicates with the suction port (35), thereby lessening excessive pressure increase of the front-side pump chamber (27-1) and suppressing pulsation phenomenon.

15 Claims, 6 Drawing Sheets

(51) Int. Cl.

| | |
|---|---|
| ***F04C 15/06*** | (2006.01) |
| ***F01C 21/10*** | (2006.01) |
| ***F04C 29/06*** | (2006.01) |
| ***F04C 15/00*** | (2006.01) |

(52) U.S. Cl.
CPC ..... *F04C 15/0049* (2013.01); *F04C 15/06* (2013.01); *F01C 21/108* (2013.01); *F04C 2/3442* (2013.01); *F04C 29/06* (2013.01)

(56) References Cited

U.S. PATENT DOCUMENTS

| | | | | |
|---|---|---|---|---|
| 6,709,242 | B2 * | 3/2004 | Watanabe | F04C 14/226 417/220 |
| 7,318,705 | B2 * | 1/2008 | Uchino | F04C 2/3441 417/220 |
| 7,931,450 | B2 * | 4/2011 | Ueki | F04C 2/3442 417/220 |
| 8,257,057 | B2 * | 9/2012 | Yamamuro | F04C 15/0023 417/220 |
| 8,690,557 | B2 * | 4/2014 | Tada | F01C 21/108 418/22 |
| 2013/0034460 | A1 | 2/2013 | Tsukada | |
| 2016/0333876 | A1 * | 11/2016 | Fujita | F04C 15/06 |

OTHER PUBLICATIONS

Written Opinion with English translation issued in corresponding application No. PCT/JP2018/030900 dated Nov. 27, 2018.

* cited by examiner

PULSATION PHENOMENON SUPPRESSION MECHANISM OF PUMP DEVICE

TECHNICAL FIELD

The present invention relates to a pump device used as a fluid pressure supply source, and more particularly to a vane-type pump device.

BACKGROUND ART

A vane-type pump device is used as a fluid pressure supply source that supplies working fluid to hydraulic equipment for a transmission, a power steering device etc. mounted in a vehicle. Such pump device is disclosed in, for instance, Japanese Unexamined Patent Application Publication No. JP2000-136781 (Patent Document 1). The pump device disclosed in Patent Document 1 is configured such that a cam ring is movably set, a pair of fluid pressure chambers are provided in a gap portion formed between the cam ring and a pump housing, fluid pressures at upstream and downstream sides of a variable metering orifice provided in a discharge passage are introduced into the pair of fluid pressure chambers respectively, and by directly exerting a pressure difference between these fluid pressures on the cam ring, the cam ring appropriately moves against an urging force of a spring that forces the cam ring in one direction, then a proper discharge flow amount control can be performed.

Here, the object of application of the present invention is a pump device that pumps liquid (fluid) as hydraulic fluid. Since a large number of pump devices pumping working fluid are used, the pump device pumping the working fluid will be explained below. However, the hydraulic fluid is not limited to the working fluid.

CITATION LIST

Patent Document

Patent Document 1: Japanese Unexamined Patent Application Publication No. JP2000-136781

SUMMARY OF THE INVENTION

Technical Problem

This kind of vane-type pump device, however, has a problem of generating pulsation in a discharge pressure of the working fluid. For instance, each pump chamber is defined by being sandwiched between adjacent two vanes, and a pump chamber when reaching a start point of a discharge port by rotation of a driving shaft is called a first pump chamber, and a pump chamber that is located at a rear side of this first pump chamber by only one pump chamber in a rotation direction is called a second pump chamber. When the first pump chamber reaches the discharge port, a high pressure working fluid at the discharge port side flows backwards into the first pump chamber, and an internal pressure of the first pump chamber rapidly increases. Due to this rapid increase, a pulsation phenomenon of the discharge pressure occurs.

Therefore, there has been a suggestion that, by forming a groove called a notch, which extends in a direction opposite to the rotation direction of a rotor, at an opening edge that is the start point of the discharge port, the pulsation of the discharge pressure should be suppressed. That is, by supplying the high pressure working fluid at the discharge port side into the first pump chamber through the notch and gradually increasing the pressure of the first pump chamber until a leading vane of the first pump chamber reaches the start point of the discharge port, the pulsation phenomenon is suppressed.

However, since the related-art notch opens only to the first pump chamber until the leading vane of the first pump chamber reaches the start point of the discharge port, a pressure control of the first pump chamber is difficult, and the internal pressure of the first pump chamber is often excessively high, then this causes a problem of occurrence of the pulsation phenomenon.

An object of the present invention is therefore to provide a new pump device that is capable of suppressing the pulsation phenomenon of the discharge pressure by properly controlling the pressure of the pump chamber defined by the adjacent two vanes of the leading-side vane and a following-side vane when the leading-side vane of the pump chamber reaches the start point of the discharge port.

Solution to Problem

According to one aspect of the present invention, a pump device comprises:

a driving shaft;

a pump element having a rotor, a plurality of vanes and a cam ring, wherein the rotor is driven and rotated by the driving shaft, and has a plurality of slits in a circumferential direction of a rotation axis of the driving shaft, the plurality of vanes are movably set in the respective slits, and the cam ring is formed into a ring shape, and forms a plurality of pump chambers by the rotor and the plurality of vanes; and a pump housing having therein a pump element accommodating space, a suction port, a discharge port, a suction passage, a discharge passage, a first communication groove, a first fluid pressure chamber and a second fluid pressure chamber, wherein the pump element accommodating space accommodates therein the pump element, the suction port faces and opens to a suction region where volumes of the pump chambers increase according to rotation of the driving shaft, the suction passage is connected to the suction port and supplies working fluid to the suction port according to the rotation of the driving shaft, the discharge port faces and opens to a discharge region where the volumes of the pump chambers decrease according to the rotation of the driving shaft, the discharge passage is connected to the discharge port, and discharges the working fluid from the discharge port according to the rotation of the driving shaft, the first communication groove has a first end portion and a second end portion which are a pair of end portions in a rotation direction of the driving shaft, the first end portion is connected to a start point of the discharge port, when a front-side vane, in the rotation direction of the driving shaft, of adjacent two vanes of the plurality of vanes is positioned at the start point of the discharge port, the second end portion is positioned at a rear side in the rotation direction of the driving shaft with respect to a rear-side vane, in the rotation direction of the driving shaft, of the adjacent two vanes, and communicates with the suction port, the first fluid pressure chamber and the second fluid pressure chamber are provided, as a pair of spaces, at an outer side, in a radial direction of the rotation axis of the driving shaft, of the cam ring in the pump element accommodating space, and serve to move the cam ring so that an eccentric amount of a center of an inner circumference of the cam ring with respect to the rotation axis of the driving shaft is changed by a pressure difference between the first fluid pressure chamber and the second fluid pressure chamber, the first fluid pressure chamber is provided at a side where a volume of the first fluid pressure chamber decreases when the cam ring moves in a direction in which the eccentric amount of the center of the inner circumference of the cam ring with respect to the rotation axis of the driving shaft becomes large, and the second fluid pressure chamber is provided at a side where a volume of the second fluid pressure chamber increases when the cam ring moves in the direction in which the eccentric amount of the center of the inner circumference of the cam ring with respect to the rotation axis of the driving shaft becomes large.

Effects of Invention

According to the present invention, when the rear-side vane (the following-side vane) in the rotation direction of the driving shaft is positioned at an end point of the suction port, the second end portion of the first communication groove is positioned at the rear side in the rotation direction of the driving shaft with respect to the front-side vane (the leading-side vane) in the rotation direction of the driving shaft, and communicates with the suction port. Therefore, a part of the working fluid in a front-side pump chamber (a leading pump chamber) can be introduced into a rear-side pump chamber (a following pump chamber) that communicates with the suction port. Excessive pressure increase of the front-side pump chamber can therefore be lessened, thereby suppressing the pulsation phenomenon.

EMBODIMENTS FOR CARRYING OUT THE INVENTION

An embodiment of the present invention will be explained in detail below with reference to the drawings. However, the present invention is not limited to the following embodiment, and includes all design modifications and equivalents belonging to the technical idea of the present invention.

Figure 1:
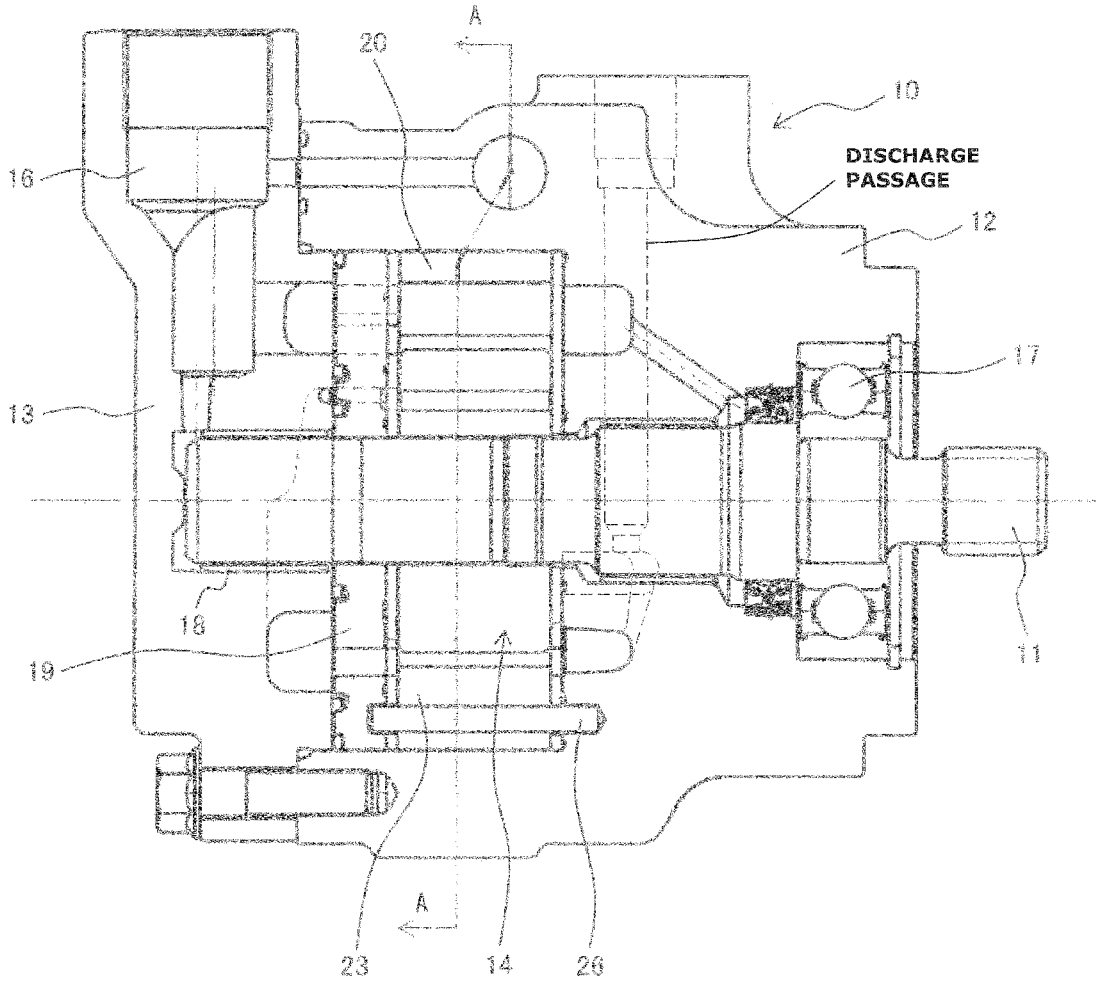
FIG. 1 is a longitudinal cross section of a vane-type pump device according to an embodiment of the present invention.
Figure 2:
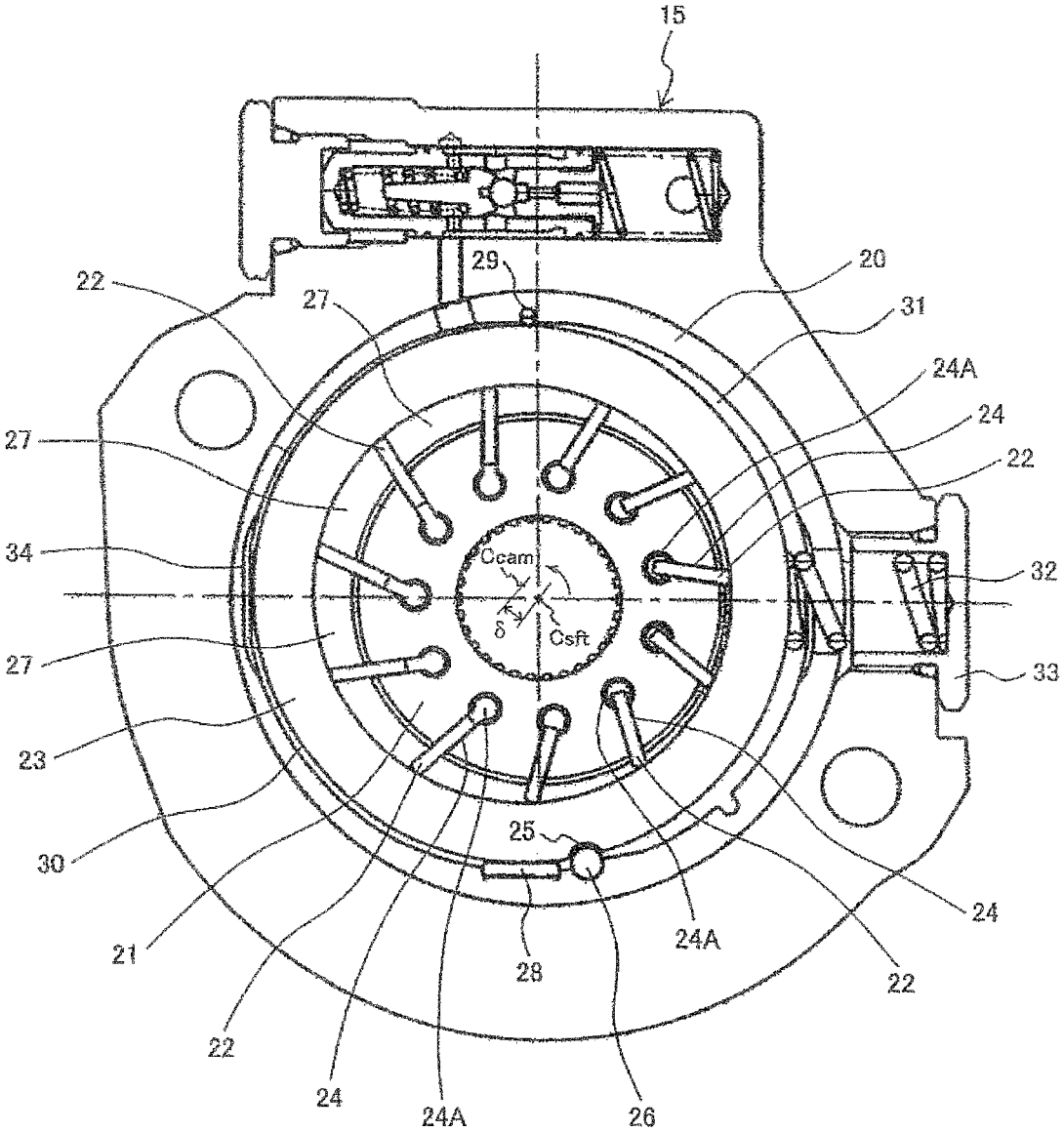
FIG. 2 is a sectional view taken along a line A-A of FIG. 1.

In FIGS. 1 and 2, a pump device of the present invention is a pump device applied to, for instance, a hydraulic power steering device of a vehicle, and used as a working fluid supply source that supplies working fluid to the hydraulic power steering device.

The power steering device has a power cylinder provided in a steering gear box. The pump device is driven by an internal combustion engine, and sucks the working fluid from a reservoir tank and discharges the working fluid to the power cylinder. The pump device assists steering (provides a steering force) by rotating a sector gear by reciprocating movement (linear movement) of a rack provided in the power cylinder. Since this kind of power steering device and its configuration are well known, their detailed explanation will be omitted here. FIG. 1 shows a cross section of the pump device used for the power steering device, cut by a plane passing through an axial center (a rotation axis) of a driving shaft of the pump device. FIG. 2 shows a sectional view taken along a line A-A of FIG. 1.

In FIG. 1, a pump device 10 has a driving shaft 11, a pump housing 12, a rear cover 13, a pump element 14 and a control valve 15 (see FIG. 2). The pump housing 12 and the rear cover 13 are enclosures, which are made of e.g. aluminum-based metal material. The rear cover 13 is provided with a suction passage 16 communicating with the reservoir tank. The pump housing 12 is provided with a discharge passage ("DISCHARGE PASSAGE" as labeled in FIG. 1) communicating with the power cylinder.

The driving shaft 11 is rotatably supported by a ball bearing 17 in the pump housing 12. Likewise, a top end of the driving shaft 11 is rotatably supported by a slide bearing 18 in the rear cover 13. This driving shaft 11 is driven by a crankshaft of the internal combustion engine. The pump element 14 is accommodated in a pump element accommodating portion formed by the housing 12 and the rear cover 13, and performs a pumping operation by being driven and rotated by the driving shaft 11. The pump element 14 has the function of sucking the working fluid from suction ports and discharging the working fluid to discharge ports.

The pump element 14 is a variable displacement-type element that variably controls a working fluid discharge amount per rotation of the driving shaft 11. The control valve 15 shown in FIG. 2 is accommodated in a valve accommodating portion. The control valve 15 controls the working fluid amount by changing a supply state of the working fluid supplied from the pump element 14 to after-mentioned fluid pressure chambers on the basis of an operating state of the pump element 14. Since this control valve 15 is not closely linked with the present embodiment, its detailed explanation will be omitted here.

The pump housing 12 forming a pump accommodating portion accommodates therein the pump element 14 and a pressure plate 19. The pressure plate 19 is located at the rear cover 13 side, and the pump element 14 is located at the pump housing 12 side. A discharge pressure acts on a surface of the pressure plate 19, which is at an opposite side to the pump element 14, then the pressure plate 19 and the pump element 14 closely contact each other. The pressure plate 19 has a disk shape, and is made of e.g. aluminum-based metal material. However, the pressure plate 19 could be made of a sintered iron-based material.

Further, an adapter ring 20 is provided at an outer circumferential side of the pump element 14. This adapter ring 20 is secured to an inner circumferential side of the pump housing 12. As shown in FIG. 2, the adapter ring 20 is formed into a substantially oval annular ring shape when viewing a cross section orthogonal to an axis of the driving shaft 11. A cam ring 23 forming the pump element 14 moves at an inner side of the adapter ring 20.

In FIG. 2, the pump element 14 is formed by a rotor 21, vanes 22 and the cam ring 23. The rotor 21 is engaged with the driving shaft 11 with splines formed at the driving shaft 11, and driven and rotated by the driving shaft 11. On an outer circumferential surface of the rotor 21, a plurality of slits 24 (in the present embodiment, eleven slits) are formed along a direction of a rotation axis (or a rotation center) Csft of the driving shaft 11. The plurality of slits 24 are arranged at regular intervals along a circumferential direction on the outer circumferential surface of the rotor 21. Each slit 24 extends obliquely in a radially outward direction from the rotation axis Csft of the driving shaft 11.

A back pressure chamber 24A is formed at a radially inner side of each slit 24, and the discharge pressure is introduced into this back pressure chamber 24A. Each of the slits 24 accommodates therein a plate-shaped vane 22. The vane 22 is set in the slit 24 so as to be able to extend/retract in the slit 24. The vane 22 is forced in the radially outward direction by the discharge pressure introduced into the back pressure chamber 24A. Therefore, the vane 22 can extend from and retract into the slit 24 by and according to rotation of the rotor 21.

The cam ring 23 is formed into an annular ring shape whose distance (an inside diameter) from a center Ccam of an inner circumferential surface of the cam ring 23 (hereinafter, simply called a center Ccam of the cam ring 23) is constant throughout the entire inner circumference of the cam ring 23, and a cam profile of the inner circumferential surface of the cam ring 23 is a cylindrical shape. Here, it is desirable that the cam ring 23 should be formed so as to have a cam profile of a perfect circle. However, the cam ring of the perfect circle does not mean a geometrically perfect circle, but means a cam ring whose profile at a design phase and/or a manufacturing stage has a circular shape. Therefore, although the inside diameter of the cam ring is constant throughout the entire inner circumference of the cam ring, this could include machining or working error.

In FIG. 2, a groove portion 25 whose cross section is a half-round shape and which extends along the rotation axis Csft of the driving shaft 11 is formed at a lower side on an outer circumferential surface of the cam ring 23. Between the groove portion 25 of the cam ring 23 and the adapter ring 20, a rod-shaped rotation stopper pin 26 is provided. As shown in FIG. 1, the rotation stopper pin 26 is press-fixed to the pump housing 12. An end portion of the rotation stopper pin 26, which is at an opposite side to the press-fixing side, is fitted into a positioning hole formed at the pressure plate 19.

The cam ring 23 is set so as to enclose the rotor 21 and the vanes 22 in the pump element accommodating portion. The cam ring 23 forms a plurality of pump chambers 27 in cooperation with the rotor 21 and the vanes 22. That is, the pressure plate 19 and the pump housing 12 are located on axial direction side surfaces of the cam ring 23 and the rotor 21. Both sides, in an axial direction of the driving shaft 11, of a ring-shaped space between the inner circumferential surface of the cam ring 23 and the outer circumferential surface of the rotor 21 are closed and sealed with the pressure plate 19 and the pump housing 12, and the ring-shaped space is divided into eleven pump chambers 27 by the plurality of vanes 22. That is, the vanes 22 forms the plurality of pump chambers 27 by circumferentially dividing the ring-shaped space in cooperation with the cam ring 23 and the rotor 21.

In FIG. 2, the cam ring 23 is set so as to move (rock) in right and left directions at the inner side of the adapter ring 20. The rotation stopper pin 26 provided between the adapter ring 20 and the cam ring 23 has the function of suppressing rotation of the pressure plate 19 with respect to the pump housing 12. Further, the rotation stopper pin 26 has the function of suppressing rotation of the adapter ring 20 with respect to the pump housing 12 and also suppressing rotation of the cam ring 23 with respect to the adapter ring 20.

The cam ring 23 is located at an inner circumferential side of the adapter ring 20, and accommodated movably (rockably) with respect to the pump housing 12. The cam ring 23 is supported by a metal-made plate-shaped supporting member 28 at the inner circumferential side of the adapter ring 20. The cam ring 23 moves by rolling on the plate-shaped supporting member 28, then rocking movement of the cam ring 23 occurs with the plate-shaped supporting member 28 being a rocking fulcrum.

When a rotation axis (or a rotation center) of the rotor 21 (=the rotation center of the driving shaft 11) is Csft and the center of the cam ring 23 is Ccam, by controlling an eccentric amount δ of the center of the cam ring 23 with respect to the center of the rotor 21, the working fluid amount can be controlled. Therefore, the cam ring 23 is provided movably (rockably) in a direction in which the eccentric amount δ of the center of the cam ring 23 with respect to the center of the rotor 21 is changed at the outer circumferential side of the rotor 21.

The rotor 21 rotates in a counterclockwise direction as shown by an arrow in FIG. 2. In a state in which the center Ccam of the cam ring 23 is eccentric with respect to the rotation axis Csft of the rotor 21, a radial direction distance between the outer circumferential surface of the rotor 21 and the inner circumferential surface of the cam ring 23 (a radial direction size of the pump chamber 27) becomes large. Each vane 22 extends and retracts toward and away from the inner circumferential surface of the cam ring 23 according to this distance change, then each pump chamber 27 is formed.

In FIG. 2, a volume of the pump chamber 27 located at a left-side region is greater than that of the pump chamber 27 located at a right-side region. By this difference of the volume of the pump chamber 27, as the rotor 21 rotates, the volume of the pump chamber 27 increases, and as the rotor 21 further rotates, the volume of the pump chamber 27 decreases. In this manner, each pump chamber 27 (the volume of each pump chamber 27) periodically increases and decreases while rotating on the rotation axis Csft of the rotor 21 in the counterclockwise direction.

The suction ports (see FIGS. 3 and 4) open in a region where the volume of the pump chamber 27 increases by and according to the rotation of the rotor 21, while the discharge ports (see FIGS. 3 and 4) open in a region where the volume of the pump chamber 27 decreases by and according to the rotation of the rotor 21. Each suction port is connected to the suction passage 16, and each discharge port is connected to the discharge passage.

A seal member 29 is provided between the adapter ring 20 and the cam ring 23 at an opposing side to the rotation stopper pin 26 of the adapter ring 20. When the cam ring 23 moves (rocks), the plate-shaped supporting member 28 as a cam supporting surface of the adapter ring 20 contacts the outer circumferential surface of the cam ring 23, and also the seal member 29 as a cam supporting surface contacts the outer circumferential surface of the cam ring 23. This seal member 29 serves to seal a gap between the adapter ring 20 and the cam ring 23, and also has the function of forming after-mentioned first and second fluid pressure chambers.

The plate-shaped supporting member 28 acts as the rocking fulcrum of the cam ring 23, and also acts as a seal member that seals a gap between the cam ring 23 and the adapter ring 20. An annular space between an inner circumferential surface of the adapter ring 20 and the outer circumferential surface of the cam ring 23 is divided into two liquid-tight spaces by the plate-shaped supporting member 28 and the seal member 29. That is, a first fluid pressure chamber 30 and a second fluid pressure chamber 31 are formed at radial direction both sides of the cam ring 23.

The first fluid pressure chamber 30 is formed at a side where the eccentric amount δ of the center Ccam of the cam ring 23 with respect to the center Csft of the rotor 21 is increased on the outer circumferential side of the cam ring 23. The second fluid pressure chamber 31 is formed at a side where the eccentric amount δ of the center Ccam of the cam ring 23 with respect to the center Csft of the rotor 21 is decreased on the outer circumferential side of the cam ring 23. As the cam ring 23 moves to the side where the eccentric amount δ is increased, a volume of the first fluid pressure chamber 30 is more decreased, and a volume of the second fluid pressure chamber 31 is more increased. A discharge pressure of a downstream side of a metering orifice provided at the control valve 15 acts on the first fluid pressure chamber 30, and a suction pressure acts on the second fluid pressure chamber 31. In the second fluid pressure chamber 31, one end of a compression spring 32 contacts the outer circumferential side of the cam ring 23. The other end of the compression spring 32 penetrates a spring penetration hole of the adapter ring 20 and is held in a spring holding hole of a plug member 33. Since the compression spring 32 is set in a compressed state, the compression spring 32 always forces the cam ring 23 with respect to the adapter ring 20 toward the first fluid pressure chamber 30. Movement of the cam ring 23 to the first fluid pressure chamber 30 side is limited by contact of the outer circumferential surface of the cam ring 23 to a flat surface portion 34 of the adapter ring 20 in the first fluid pressure chamber 30.

In a state in which the rotor 21 rotates at high speed, since the discharge pressure acts on the first fluid pressure chamber 30, pressure of the first fluid pressure chamber 30 increases, and the cam ring 23 moves (or rocks) toward the second fluid pressure chamber 31 against an urging force of the compression spring 32. In this case, the eccentric amount δ of the center Ccam of the cam ring 23 with respect to the center Csft of the rotor 21 is decreased.

On the other hand, in a state in which the rotor 21 rotates at low speed, since the discharge pressure does not act on the first fluid pressure chamber 30, the pressure of the first fluid pressure chamber 30 decreases, and the cam ring 23 moves (or rocks) toward the first fluid pressure chamber 30 by the urging force of the compression spring 32. In this case, the eccentric amount δ of the center Ccam of the cam ring 23 with respect to the center Csft of the rotor 21 is increased.

In such pump device 10, the rotor 21 is driven and rotates in the counterclockwise direction shown by the arrow in FIG. 2 by the driving shaft 11. At this time, the pump chambers 27 move circumferentially while their volumes are increased and decreased, thereby performing a pumping operation. The working fluid is introduced into an inside of the suction passage 16 through a suction pipe that is connected to the reservoir tank. The working fluid in a suction region is sucked into each pump chamber 27 from the suction ports by a pump sucking operation. Further, the working fluid discharged from each pump chamber 27 by a pump discharging operation is discharged outside the pump housing 12 through the discharge ports and the discharge passage, and supplied to the power cylinder of the power steering device.

Figure 3:
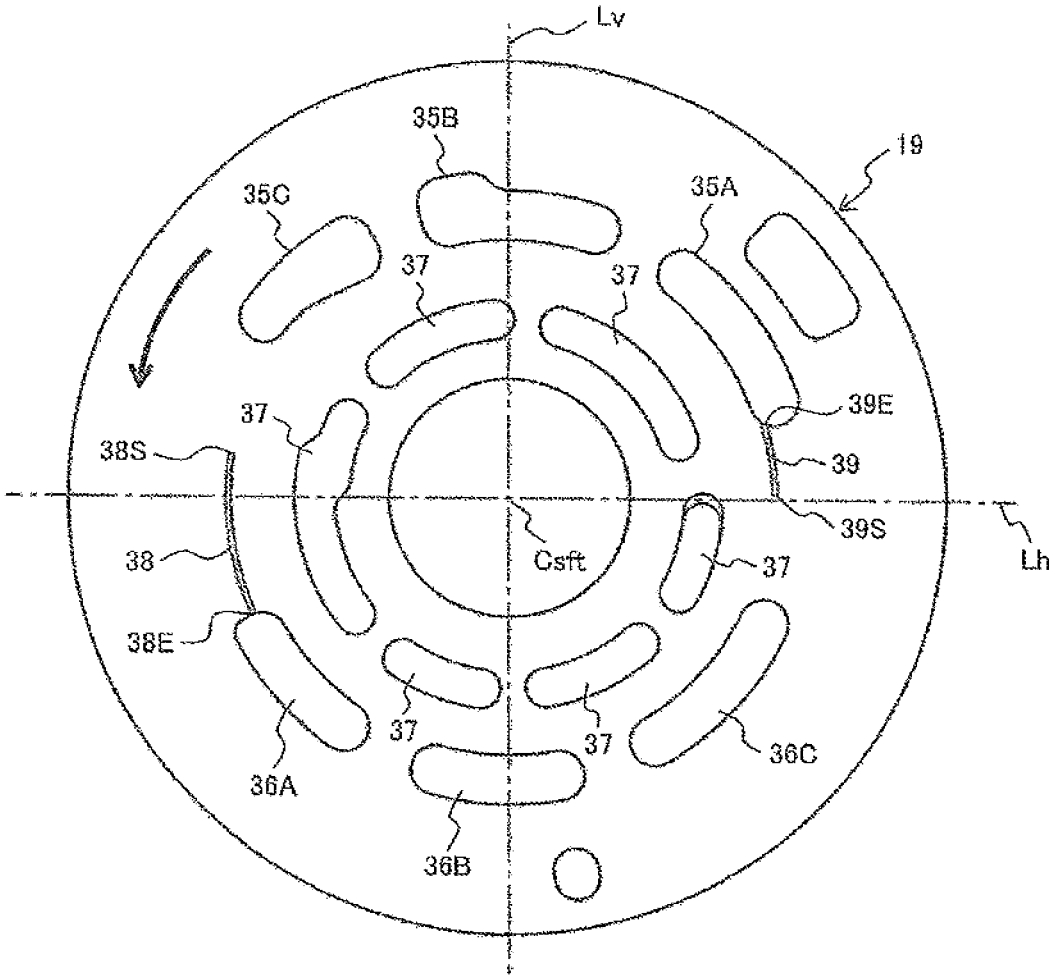
FIG. 3 is a plan view of a pressure plate shown in FIG. 1, viewed from a suction port and discharge port side.

Next, an improved configuration of the pump device described in the present embodiment and its working and effect will be explained with reference to FIGS. 3 to 6. FIG. 3 shows shapes and arrangements of the suction ports and the discharge ports provided at the pressure plate 19.

In FIG. 3, in an upper side region with the rotation axis Csft of the driving shaft 11 being a boundary, suction ports 35A, 35B and 35C, which are annularly arranged with the rotation axis Csft of the driving shaft 11 being a center, are formed. The suction ports 35A, 35B and 35C are connected together in the rear cover 13, and communicate with the suction passage 16 (see FIG. 1).

The suction port 35A is a front-side suction port (hereinafter, called a front-side suction port 35A). The suction port 35C is a rear-side suction port (hereinafter, called a rear-side suction port 35C). The suction port 35B is a middle suction port (hereinafter, called a middle suction port 35B) located between the front-side suction port 35A and the rear-side suction port 35C, and could be deleted in some cases. Further, one suction port might be formed by combining all of the suction ports.

In a lower side region with the rotation axis Csft of the driving shaft 11 being the boundary, discharge ports 36A, 36B and 36C, which are annularly arranged with the rotation axis Csft of the driving shaft 11 being a center, are formed. The discharge ports 36A, 36B and 36C are connected together in the pump housing 12, and communicate with the discharge passage (not shown).

The discharge port 36A is a front-side discharge port (hereinafter, called a front-side discharge port 36A). The discharge port 36C is a rear-side discharge port (hereinafter, called a rear-side discharge port 36C). The discharge port 36B is a middle discharge port (hereinafter, called a middle discharge port 36B) located between the front-side discharge port 36A and the rear-side discharge port 36C, and could be deleted in some cases. Further, one discharge port might be formed by combining all of the discharge ports.

Here, the above upper side region and lower side region are defined as follows. That is, in FIG. 3, a line connecting middle portions of the middle suction port 35B and the middle discharge port 36B and the rotation axis Csft of the driving shaft 11 is a vertical straight line Lv, and a line orthogonal to this vertical straight line Lv at the rotation axis Csft of the driving shaft 11 is a horizontal straight line Lh. When defining these lines, in an upper side region of the horizontal straight line Lh, the front-side suction port 35A, the middle suction port 35B and the rear-side suction port 35C are formed, and in a lower side region of the horizontal straight line Lh, the front-side discharge port 36A, the middle discharge port 36B and the rear-side discharge port 36C are formed. It is noted that the suction ports 35A to 35C and the discharge ports 36A to 36C are formed at positions whose distances from the rotation axis Csft of the driving shaft 11 are the same.

Further, pressure openings 37 through which the discharge pressure is exerted on the back pressure chambers 24A of the slits 24 are formed at inner circumferential sides of the annularly-arranged suction ports 35A, 35B and 35C and the annularly-arranged discharge ports 36A, 36B and 36C. These suction ports 35A, 35B and 35C, discharge ports 36A, 36B and 36C and pressure openings 37 are formed on a side surface, located on the rotor 21 side, of the pressure plate 19.

Furthermore, a first communication groove (so-called "notch") 38, which is also formed on the side surface, located on the rotor 21 side, of the pressure plate 19, is connected to a start point of the front-side discharge port 36A formed on the side surface, located on the rotor 21 side, of the pressure plate 19. This first communication groove 38 extends in a direction opposite to a rotation direction of the vanes 22 shown by an arrow, i.e. toward the rear-side suction port 35C.

The first communication groove 38 has a first end portion 38E that is connected to the start point of the front-side discharge port 36A and a second end portion 38S that extends toward the rear-side suction port 35C. Here, the first communication groove 38 is formed into an arc-shape in a circumferential direction with the rotation axis Csft of the driving shaft 11 being a center. The first communication groove 38 has the function of lessening or moderating a pressure increase of the pump chamber 27 before shifting to a discharge stage.

Likewise, a second communication groove (so-called "notch") 39, which is also formed on the side surface, located on the rotor 21 side, of the pressure plate 19, is connected to a start point of the front-side suction port 35A formed on the side surface, located on the rotor 21 side, of the pressure plate 19. This second communication groove 39 extends in the direction opposite to the rotation direction of the vanes 22 shown by the arrow, i.e. toward the rear-side discharge port 36C. The second communication groove 39 has a third end portion 39E that is connected to the start point of the front-side suction port 35A and a fourth end portion 39S that extends toward the rear-side discharge port 36C.

Here, the second communication groove 39 is also formed into an arc-shape in the circumferential direction with the rotation axis Csft of the driving shaft 11 being a center. The second communication groove 39 has the function of lessening or moderating a pressure decrease of the pump chamber 27 before shifting to a suction stage.

Next, a position relationship between the suction ports 35, the second communication groove 39, the discharge ports 36, the first communication groove 38 and the vanes 22 forming the pump chambers 27 for each operating state will be explained with reference to FIGS. 4 to 6.

«Low Speed Rotation Operation»

Figure 4:
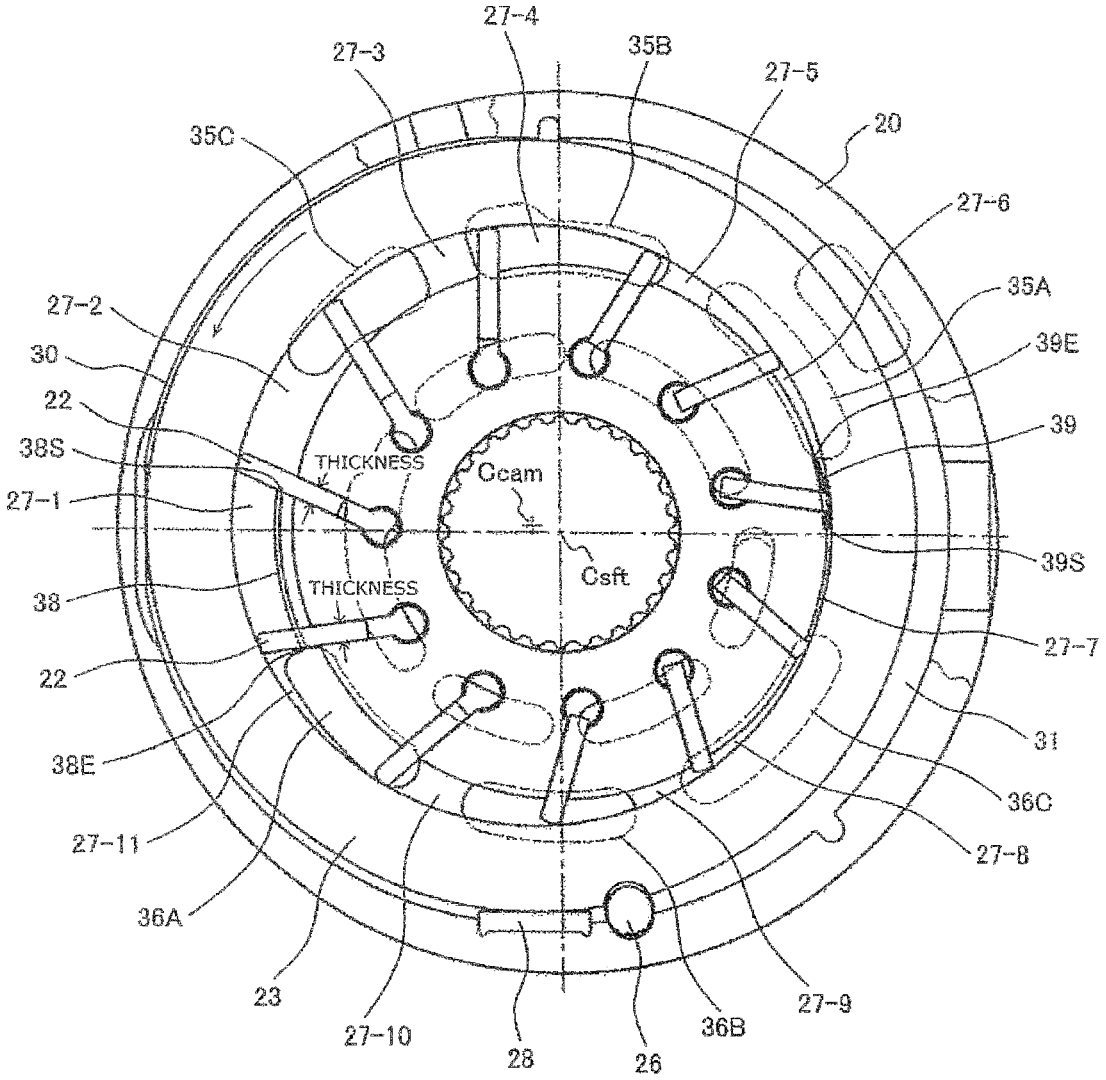
FIG. 4 is a drawing for explaining a position relationship between vanes, suction ports and discharge ports when these vanes, suction ports and discharge ports are located at a first position relationship.

FIG. 4 shows positions of the vanes 22 and a position relationship between the suction ports 35, the discharge ports 36, the first communication groove 38 and the second communication groove 39. FIG. 4 depicts a state just before the vane 22 reaches the start point of the front-side discharge port 36A to which the first end portion 38E of the first communication groove 38 is connected. On the other hand, FIG. 5 depicts a state in which the vane 22 is crossing the start point of the front-side discharge port 36A to which the first end portion 38E of the first communication groove 38 is connected.

Figure 5:
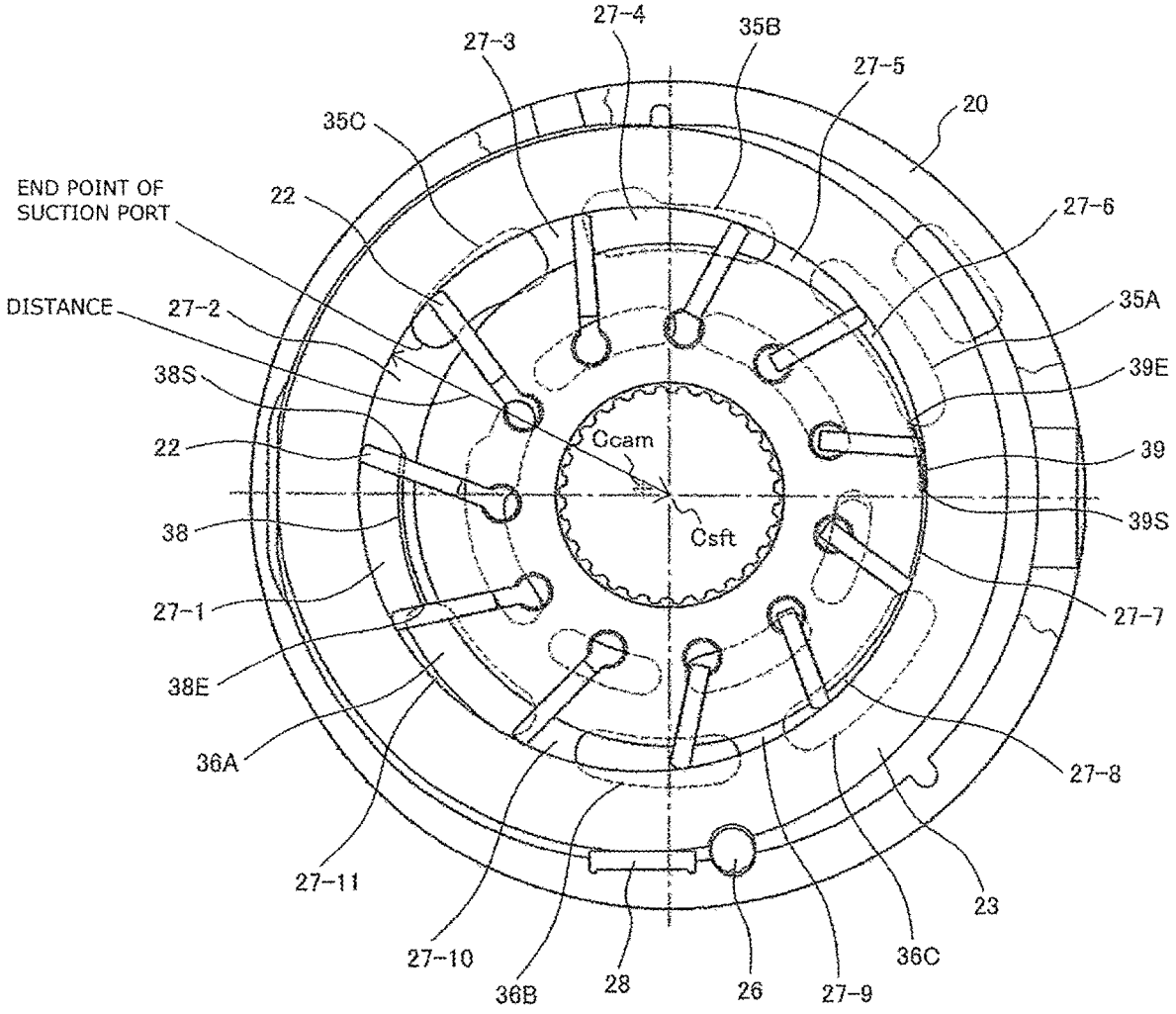
FIG. 5 is a drawing for explaining a position relationship between the vanes, the suction ports and the discharge ports when these vanes, suction ports and discharge ports are located at a second position relationship.

Here, since FIGS. 4 and 5 are both the low speed rotation operation, the pressure of the first fluid pressure chamber 30 decreases, and the cam ring 23 moves (or rocks) to the first fluid pressure chamber 30 side by the urging force of the compression spring 32. In this case, the eccentric amount δ of the center Ccam of the cam ring 23 with respect to the center Csft of the rotor 21 is a maximum eccentric amount.

In FIG. 4, the eleven pump chambers 27 are formed by the rotor 21, the vanes 22 and the cam ring 23. For the sake of convenience, the pump chamber to which the first communication groove 38 opens or faces is defined as a first pump chamber 27-1. Then, the pump chambers 27 following this first pump chamber 27-1 are a second pump chamber 27-2, a third pump chamber 27-3, . . . an eleventh pump chamber 27-11 in rotation, and the first pump chamber 27-1 comes again.

The state shown in FIG. 4 is a state just before a front-side vane (hereinafter, called a leading-side vane) 22 of the first pump chamber 27-1 reaches the start point of the front-side discharge port 36A to which the first end portion 38E of the first communication groove 38 is connected, and also a state in which a rear-side vane (hereinafter, called a following-side vane) 22 of the first pump chamber 27-1 overlaps the second end portion 38S of the first communication groove 38. It is noted that, regarding these leading-side vane 22 and following-side vane 22, the following-side vane 22 of a front-side pump chamber 27 corresponds to the leading-side vane 22 of a rear-side pump chamber 27 that follows the front-side pump chamber 27.

Therefore, in the state of FIG. 4, high pressure working fluid of the front-side discharge port 36A flows into the first pump chamber 27-1 through the first communication groove 38. Because of this, pressure of the first pump chamber 27-1 increases by pressure of this incoming working fluid. Here, in a case where the first communication groove 38 opens or faces only to the first pump chamber 27-1, when the rotor 21 rotates and the first pump chamber 27-1 moves in a moving direction shown by an arrow, there is a risk that the pressure of the first pump chamber 27-1 will excessively increase frequently, and this causes the pulsation.

Thus, in the present embodiment, the pump device is configured such that when the first pump chamber 27-1 moves in the moving direction from the state shown in FIG. 4 by the rotation of the rotor 21 and shifts to the state shown in FIG. 5, i.e. when the leading-side vane 22 of the first pump chamber 27-1 moves to a position that passes across the first end portion 38E of the first communication groove 38 and the following-side vane 22 of the first pump chamber 27-1 also moves with the movement of the leading-side vane 22, the first pump chamber 27-1 communicates with the rear-side suction port 35C through the first communication groove 38.

That is, when the leading-side vane 22 of the first pump chamber 27-1 moves to the position that passes across the first end portion 38E of the first communication groove 38 and also the following-side vane 22 moves with the movement of the leading-side vane 22, the second end portion 38S of the first communication groove 38 opens or faces to a rear side in the rotation direction by the leading-side vane 22 of the second pump chamber 27-2. Therefore, the first pump chamber 27-1 and the second pump chamber 27-2 communicate with each other through the first communication groove 38.

Since the following-side vane 22 of the second pump chamber 27-2 is still positioned at some midpoint of the rear-side suction port 35C in this state, the second pump chamber 27-2 still communicates with the low pressure rear-side suction port 35C. Because of this, the second pump chamber 27-2 is in a lower pressure state than that of the first pump chamber 27-1. A part of the working fluid in the first pump chamber 27-1 consequently flows into the second pump chamber 27-2 through the first communication groove 38, and thus a maximum pressure of the first pump chamber 27-1 is decreased, then the pulsation can be reduced.

When the first pump chamber 27-1 further moves and the leading-side vane 22 of the first pump chamber 27-1 passes across the start point of the front-side discharge port 36A, much working fluid flows into the first pump chamber 27-1 from the front-side discharge port 36A. However, at this time, since the first communication groove 38 opens to the first pump chamber 27-1 and the second pump chamber 27-2 and also the second pump chamber 27-2 opens to the rear-side suction port 35C, a pressure decrease of the first pump chamber 27-1 is suppressed. Here, at this time, when an opening area of the first communication groove 38 communicating with the second pump chamber 27-2 is increased by the movement of the following-side vane 22 of the first pump chamber 27-1, a pressure increase of the second pump chamber 27-2 can be promoted.

In this manner, an entire length in the circumferential direction of the first communication groove 38 is set to be longer than the sum of a length in the circumferential direction of the pump chamber 27 sandwiched between the adjacent two vanes and a thickness ("THICKNESS" as labeled in FIG. 4) of the one vane 22. That is, in the vane-type pump device, since one "closed region" is formed by one pump chamber 27, by setting the entire circumferential direction length of the first communication groove 38 to be longer than the sum of a circumferential direction length of this "closed region" and the thickness of the one vane, the incoming high pressure working fluid that flows backwards from the discharge port 36A can be surely introduced into the suction port before the pump chamber 27 passing through the "closed region" starts to communicate with the discharge port 36A.

Likewise, as for the second communication groove 39 connected to the front-side suction port 35A, the working fluid flows from a high pressure-side pump chamber 27 into a low pressure-side pump chamber 27, then the second communication groove 39 serves to suppress the pulsation of the discharge pressure. If the second communication groove 39 is not provided, the pressure of the pump chamber 27 moving from a discharge region to the suction region rapidly changes from a high discharge pressure to a low suction pressure, which is also one of factors of the pulsation of the discharge pressure.

Therefore, in the present embodiment, as shown in FIG. 4, a configuration for decreasing the pressure of the high pressure pump chamber by the second communication groove 39 connected to the start point of the front-side suction port 35A is employed. That is, in a state just before the leading-side vane 22 of a seventh pump chamber 27-7 reaches the fourth end portion 39S of the second communication groove 39, the seventh pump chamber 27-7 is in a high pressure state. Then, when the leading-side vane 22 of the seventh pump chamber 27-7 reaches a position that passes across the fourth end portion 39S of the second communication groove 39 by and according to the rotation of the rotor 21 as shown in FIG. 4, the working fluid in the seventh pump chamber 27-7 flows into a low pressure sixth pump chamber 27-6. It is therefore possible to decrease the pressure of the seventh pump chamber 27-7 at an early time, thereby suppressing the pulsation of the discharge pressure.

Further, as can be understood from FIG. 3, the first communication groove 38 is formed so that its entire length is longer than that of the second communication groove 39. By setting the first communication groove 38 to be longer in this manner, a pre-compression region in a transition region from the suction region to the discharge region can be increased or longer, then a pre-compression effect can be adequately obtained.

Furthermore, the second end portion 38S of the first communication groove 38 and the fourth end portion 39S of the second communication groove 39 are formed at positions at which the vanes 22 do not cross the second end portion 38S and the fourth end portion 39S at the same time (the vanes 22 do not reach the second end portion 38S and the fourth end portion 39S at the same time). That is, when the vane 22 crosses the second end portion 38S of the first communication groove 38, the vane 22 does not cross the fourth end portion 39S of the second communication groove 39.

In this manner, the first communication groove 38 and the second communication groove 39 are configured such that when any one of the plurality of vanes 22 is located at an overlap position with the second end portion 38S of the first communication groove 38, none of the plurality of vanes 22 overlap the fourth end portion 39S of the second communication groove 39.

For instance, in FIG. 4, when the leading-side vane 22 of the second pump chamber 27-2 starts to overlap the second end portion 38S of the first communication groove 38, the pressure of the second pump chamber 27-2 following this leading-side vane 22 starts to increase. On the other hand, when the leading-side vane 22 of the seventh pump chamber 27-7 starts to overlap the fourth end portion 39S of the second communication groove 39, the pressure of the seventh pump chamber 27-7 following this leading-side vane 22 starts to decrease. By shifting timing of these pressure changes, change of the working fluid pressure, especially an amplitude, is reduced, then the pulsation can be reduced.

Here, there is a need to properly control an amount of the working fluid flowing in the first communication groove 38. If the amount of the working fluid flowing in the first communication groove 38 is too large, this might lead to increase in pumping loss. For this reason, in the present embodiment, at least a sectional area of the first communication groove 38 in a rotation axis Csft direction of the driving shaft 11 is set to 0.8 $mm^2$ at the most (i.e. 0.8 $mm^2$ or less). As a matter of course, if the amount of the working fluid flowing in the first communication groove 38 is too small, there is a risk of not adequately obtaining a pulsation reduction effect. Therefore, a minimum sectional area of the first communication groove 38 can also be set by design.

Further, the sectional area of the first communication groove 38 is set to a constant size throughout the entire range in the circumferential direction from the first end portion 38E to the second end portion 38S of the first communication groove 38. With this, since there is no change in the sectional area of the first communication groove 38, the pulsation reduction effect of the first communication groove 38 can be uniformly obtained regardless of the position of the pump chamber 27.

Here, the constant size of the sectional area of the first communication groove 38 throughout the entire range in the circumferential direction means that the first communication groove 38 is designed and manufactured so as to substantially have the constant size of the sectional area throughout the entire range in the circumferential direction, and does not exclude a case where the sectional area of the first communication groove 38 is changed due to manufacturing error. In addition, even if the end portions 38S and 38B of the first communication groove 38 are shaped into, e.g. a half-round shape, change of the sectional area due to these shapes are not excluded.

Figure 6:
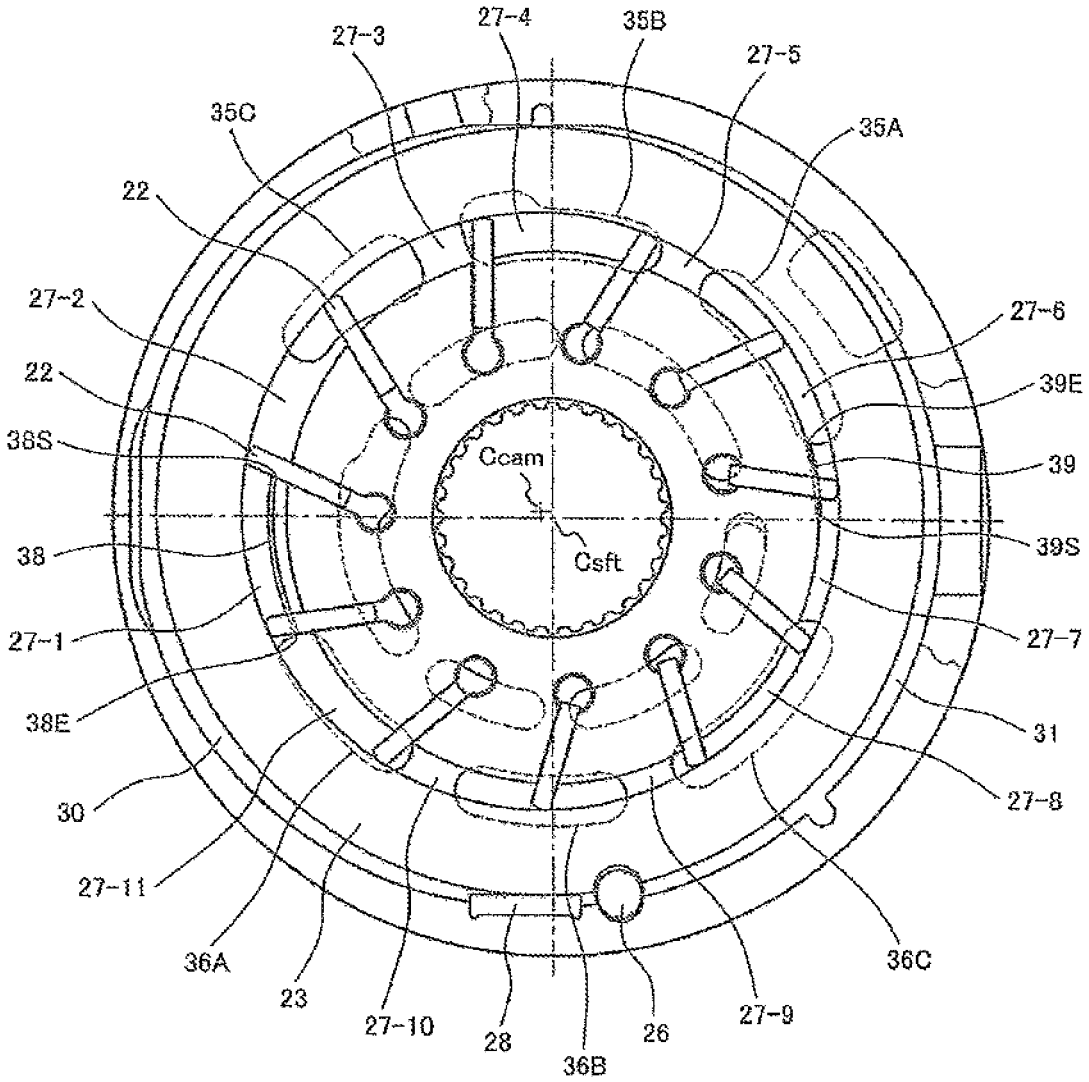
FIG. 6 is a drawing for explaining a position relationship between the vanes, the suction ports and the discharge ports when these vanes, suction ports and discharge ports are located at a third position relationship.

Although the above explanation is concerned with the low speed rotation operation in which the eccentric amount δ of the center Ccam of the cam ring 23 with respect to the rotation axis Csft of the driving shaft 11 is the maximum, FIG. 6 shows a high speed rotation operation in which the eccentric amount δ of the center Ccam of the cam ring 23 with respect to the rotation axis Csft of the driving shaft 11 is small. The eccentric amount δ can be controlled within a range from a minimum eccentric amount to the maximum eccentric amount by continuously controlling a position of the cam ring 23 by a pressure control of the first fluid pressure chamber 30 and the second fluid pressure chamber 31.

«High Speed Rotation Operation«

In FIG. 6, high pressure working fluid flows into the first fluid pressure chamber 30 from the discharge side, and by this flow of the high pressure working fluid, the cam ring 23 compresses the compression spring 32 and moves (or rocks) to the right side. With this operation, volumes of the pump chambers 27 at the discharge side decrease, and the working fluid discharge amount is decreased. At this time, the leading-side vane 22 and the following-side vane 22 of the first pump chamber 27-1 are positioned at the same positions as those in FIG. 4. Therefore, in this state, the same working or operation as that of the case shown in FIG. 4 is performed.

Then, when the first pump chamber 27-1 moves in the moving direction from the state shown in FIG. 6 by the rotation of the rotor 21, i.e. when the leading-side vane 22 of the first pump chamber 27-1 moves to a position that passes across the first end portion 38E of the first communication groove 38 and the following-side vane 22 of the first pump chamber 27-1 also moves with the movement of the leading-side vane 22, the first pump chamber 27-1 communicates with the second pump chamber 27-2 through the first communication groove 38. Therefore, in this state, the same working or operation as that of the case shown in FIG. 5 is performed.

On the other hand, when the eccentric amount δ of the center Ccam of the cam ring 23 with respect to the rotation axis Csft of the driving shaft 11 is the minimum, the cam ring 23 moves away from the suction port 35C, and approaches the discharge port 36C. Therefore, there is a difference between FIG. 4 and FIG. 6 in an overlap position of the vane 22 located between the seventh pump chamber 27-7 and an eighth pump chamber 27-8 with the rear-side discharge port 36C. That is, in the high speed rotation operation shown in FIG. 6, a closing timing of the rear-side discharge port 36C becomes later. With this, communication between the rear-side discharge port 36C and the second communication groove 39 connected to the front-side suction port 35A is maintained over a long section. In the present embodiment, the pump device is configured such that as the eccentric amount δ becomes smaller, the closing timing becomes later.

When the eccentric amount δ of the center Ccam of the cam ring 23 with respect to the rotation axis Csft of the driving shaft 11 is small, a communication state between the seventh pump chamber 27-7 and the rear-side discharge port 36C becomes long, thereby obtaining the pulsation reduction effect in a wide angular range. At this time, although pumping loss occurs due to the fact that the discharge pressure is discharged to the suction side, since the pump discharge amount per rotation is controlled, decrease in the discharge amount can be suppressed.

Next, further characteristic configurations, which are different from technical matters of the present embodiment described above, and their operations will be explained.

The cam ring 23 is configured to have a shape by which, in the above pump device, when the following-side vane 22, located at the rear side in the rotation direction of the driving shaft 11, of the adjacent two vanes of the plurality of vanes 22 is located at an end point of the rear-side suction port 35C in the state in which the eccentric amount δ of the center Ccam of the cam ring 23 with respect to the rotation axis Csft of the driving shaft 11 is the maximum, in the "closed region" that is a region between the leading-side vane 22, located at the front side in the rotation direction of the driving shaft 11, and the end point of the rear-side suction port 35C, a distance between the inner circumferential surface of the cam ring 23 and the rotation axis Csft of the driving shaft 11 does not increase (the pump chamber does not expand) toward the rotation direction of the driving shaft 11.

With this configuration, at a timing when one pump chamber 27 of the plurality of pump chambers 27 has just separated from the end point of the rear-side suction port 35C, the working fluid flows into the pump chamber 27 located in the "closed region" through the first communication groove 38. Since a cam profile in this "closed region" is set to a profile that does not expand, an internal pressure, which is increased due to the flow of the working fluid from the discharge port side, of the pump chamber 27 located in the "closed region" can be maintained. As a result, it is possible to lessen a pressure change when the pump chamber 27 located in the "closed region" communicates with the front-side discharge port 36A, thereby reducing the pulsation.

If the cam profile is a profile by which the pump chamber 27 expands, the internal pressure of the pump chamber 27 located in the "closed region" is decreased according to this expansion, and the pressure change when the pump chamber 27 located in the "closed region" communicates with the front-side discharge port 36A becomes great, then there is a risk of occurrence of large pulsation.

Here, the term "closed region" does not mean a state in which a region does not communicate with any of the rear-side suction port 35C, the front-side discharge port 36A and the first communication groove 38, but indicates the above technical matters. Here, in the case where one suction port is formed by combining all the suction ports and one discharge port is formed by combining all the discharge ports, these one suction port and one discharge port are merely called the suction port and the discharge port respectively.

Further, the cam ring 23 is configured to have a shape by which, in the state in which the eccentric amount δ of the center Ccam of the cam ring 23 with respect to the rotation axis Csft of the driving shaft 11 is the maximum, in the "closed region", the distance between the inner circumferential surface of the cam ring 23 and the rotation axis Csft of the driving shaft 11 decreases toward the rotation direction of the driving shaft 11, which is related to the above technical matters.

With this configuration, since the cam profile in the "closed region" is set to a compression profile by which the pump chamber 27 gets smaller, the internal pressure of the pump chamber 27 located in a first closed region is further increased. It is thus possible to further lessen the pressure change when this pump chamber 27 communicates with the front-side discharge port 36A.

Moreover, the cam ring 23 is configured such that in the state in which the eccentric amount δ of the center Ccam of the cam ring 23 with respect to the rotation axis Csft of the driving shaft 11 is the maximum, the center Ccam of the cam ring 23 is positioned at the suction region side with respect to the rotation axis Csft of the driving shaft 11 in a direction of a line connecting the cam supporting surface of the plate-shaped supporting member 28 and the rotation axis Csft of the driving shaft 11 when viewing the cross section orthogonal to the rotation axis Csft of the driving shaft 11.

With this configuration, the cam ring 23 is in so-called cam-lift state in which the center Ccam of the cam ring 23 is located at the region side of the suction ports 35A to 35C with respect to the rotation axis Csft of the driving shaft 11. Therefore, as compared with a case of no-cam-lift, a volume change of the pump chamber 27 located in the "closed region" occurs toward a direction in which the volume is compressed, then the internal pressure of the pump chamber 27 located in the "closed region" can be easily maintained.

Furthermore, by employing the above configuration, in a pump drive state in which the pump chambers 27 discharge the working fluid, the pressure of the working fluid at the region side of the discharge ports 36A to 36C is high, and the cam ring 23 is pressed against the cam supporting surface of the plate-shaped supporting member 28 by this high pressure. Here, although an amount of the cam-lift is decreased by this high pressure, by configuring the cam ring 23 so as to maintain the cam-lift state also in the pump drive state of the pump device, the internal pressure of the pump chamber 27 located in the "closed region" can be easily maintained.

In addition, in the above pump device, a distance from the center Ccam of the cam ring 23 to the inner circumferential surface of the cam ring 23 when viewing the cross section orthogonal to the rotation axis Csft of the driving shaft 11 is constant throughout the entire circumference in the circumferential direction of the rotation axis Csft of the driving shaft 11. That is, the shape of the cam ring 23 is so-called perfect circle. This facilitates manufacturing of the cam ring 23. Here, even though this cam ring 23 is the perfect circle, since the cam ring 23 is provided inside the adapter ring 20 in the cam-lift state, the above compression profile can be formed in the "closed region".

In addition, in the above pump device, the cam ring 23 is configured so that its relative rotation with respect to the adapter ring 20 is limited by the rotation stopper pin 26. With this configuration, the following working and effect can be obtained.

At the region side of the suction ports 35A to 35C, a pressure difference between a top end side (a side that contacts the inner circumferential surface of the cam ring 23) of the vane 22 and a base end side (at the rotor side) of the vane 22 is large, and a pressing force that presses the top end of the vane 22 on the inner circumferential surface of the cam ring 23 is great. Because of this, there is a case where the inner circumferential surface of the cam ring 23 undergoes tempering by frictional heat by the rotation of the vane 22.

In a case where the rotation stopper pin 26 is not provided, if this tempered portion moves, by rotation of the cam ring 23, to the discharge region side where heavy load is exerted, there is a risk that breakage of the cam ring 23 will occur. Therefore, by providing the rotation stopper pin 26 suppressing rotation of the cam ring 23, the tempered portion by the frictional heat by the rotation of the vane can be prevented from moving to the discharge region side. As a consequence, the breakage of the cam ring 23 can be suppressed.

As described above, according to the present invention, the communication groove that extends from the start point of the discharge port in the direction opposite to the rotation direction of the vane is formed, the first end portion of this communication groove is connected to the start point of the discharge port, and when the front-side vane in the rotation direction of the driving shaft is positioned at the start point of the discharge port, the second end portion of the communication groove is positioned at the rear side in the rotation direction of the driving shaft with respect to the rear-side vane and communicates with the suction port. With this configuration, apart of the working fluid in the front-side pump chamber (the leading pump chamber) can be introduced into the rear-side pump chamber (the following pump chamber) that communicates with the suction port. Excessive pressure increase of the front-side pump chamber can therefore be lessened, thereby suppressing the pulsation phenomenon.

The present invention is not limited to the above embodiment, and includes all design modifications. The above embodiment is an embodiment that is explained in detail to easily understand the present invention, and the present invention is not necessarily limited to the embodiment having all elements or components described above. Further, a part of the configuration of the embodiment can be replaced with a configuration of other embodiments. Also, the configuration of other embodiments could be added to the configuration of the embodiment. Moreover, regarding a part of the configuration of the embodiment, the configuration of other embodiments could be added, removed and replaced.

As the pump device based on the embodiment explained above, for instance, the followings are raised.

As one aspect of the present invention, a pump device comprising: a driving shaft; a pump element having a rotor, a plurality of vanes and a cam ring, wherein the rotor is driven and rotated by the driving shaft, and has a plurality of slits in a circumferential direction of a rotation axis of the driving shaft, the plurality of vanes are movably set in the respective slits, and the cam ring is formed into a ring shape, and forms a plurality of pump chambers by the rotor and the plurality of vanes; and a pump housing having therein a pump element accommodating space, a suction port, a discharge port, a suction passage, a discharge passage, a first communication groove, a first fluid pressure chamber and a second fluid pressure chamber, wherein the pump element accommodating space accommodates therein the pump element, the suction port faces and opens to a suction region where volumes of the pump chambers increase according to rotation of the driving shaft, the suction passage is connected to the suction port, and supplies working fluid to the suction port according to the rotation of the driving shaft, the discharge port faces and opens to a discharge region where the volumes of the pump chambers decrease according to the rotation of the driving shaft, the discharge passage is connected to the discharge port, and discharges the working fluid from the discharge port according to the rotation of the driving shaft, the first communication groove has a first end portion and a second end portion which are a pair of end portions in a rotation direction of the driving shaft, the first end portion is connected to a start point of the discharge port, when a front-side vane, in the rotation direct ion of the driving shaft, of adjacent two vanes of the plurality of vanes is positioned at the start point of the discharge port, the second end portion is positioned at a rear side in the rotation direction of the driving shaft with respect to a rear-side vane, in the rotation direction of the driving shaft, of the adjacent two vanes, and communicates with the suction port, the first fluid pressure chamber and the second fluid pressure chamber are provided, as a pair of spaces, at an outer side, in a radial direction of the rotation axis of the driving shaft, of the cam ring in the pump element accommodating space, and serve to move the cam ring so that an eccentric amount of a center of an inner circumference of the cam ring with respect to the rotation axis of the driving shaft is changed by a pressure difference between the first fluid pressure chamber and the second fluid pressure chamber, the first fluid pressure chamber is provided at a side where a volume of the first fluid pressure chamber decreases when the cam ring moves in a direction in which the eccentric amount of the center of the inner circumference of the cam ring with respect to the rotation axis of the driving shaft becomes large, and the second fluid pressure chamber is provided at a side where a volume of the second fluid pressure chamber increases when the cam ring moves in the direction in which the eccentric amount of the center of the inner circumference of the cam ring with respect to the rotation axis of the driving shaft becomes large.

As a preferable pump device, the cam ring has a shape by which when the cam ring is located at a position at which the eccentric amount of the center of the inner circumference of the cam ring with respect to the rotation axis of the driving shaft is a maximum and the rear-side vane, in the rotation direction of the driving shaft, of the adjacent two vanes of the plurality of vanes is positioned at an end point of the suction port, in a first closed region that is a region between the front-side vane in the rotation direction of the driving shaft and the end point of the suction port, a distance between an inner circumferential surface of the cam ring and the rotation axis of the driving shaft does not increase toward the rotation direction of the driving shaft.

As a far preferable pump device, in any one of the above pump devices, the cam ring has a shape by which when the cam ring is located at the position at which the eccentric amount of the center of the inner circumference of the cam ring with respect to the rotation axis of the driving shaft is the maximum, in the first closed region, the distance between the inner circumferential surface of the cam ring and the rotation axis of the driving shaft decreases toward the rotation direction of the driving shaft.

As a far preferable pump device, in any one of the above pump devices, the pump housing has a cam supporting surface that contacts an outer-side surface, in the radial direction of the rotation axis of the driving shaft, of the cam ring, and the cam ring is provided so that when the cam ring is located at the position at which the eccentric amount of the center of the inner circumference of the cam ring with respect to the rotation axis of the driving shaft is the maximum, the center of the inner circumference of the cam ring is positioned at a suction region side with respect to the rotation axis of the driving shaft in a direction of a line connecting the cam supporting surface and the rotation axis of the driving shaft when viewing a cross section orthogonal to the rotation axis of the driving shaft.

As a far preferable pump device, in any one of the above pump devices, the cam ring is provided so that, even in a state in which the working fluid is sucked from the suction port and discharged from the discharge port, when the cam ring is located at the position at which the eccentric amount of the center of the inner circumference of the cam ring with respect to the rotation axis of the driving shaft is the maximum, the center of the inner circumference of the cam ring is positioned at the suction region side with respect to the rotation axis of the driving shaft in the direction of the line connecting the cam supporting surface and the rotation axis of the driving shaft when viewing the cross section orthogonal to the rotation axis of the driving shaft.

As a far preferable pump device, in any one of the above pump devices, a distance from the center of the inner circumference of the cam ring to the inner circumference of the cam ring when viewing the cross section orthogonal to the rotation axis of the driving shaft is constant throughout an entire circumference in the circumferential direction of the rotation axis of the driving shaft.

As a far preferable pump device, any one of the above pump devices further comprising: a rotation stopper pin, wherein the rotation stopper pin is provided in the pump element accommodating space, and limits a relative rotation of the cam ring with respect to the pump housing in the circumferential direction of the rotation axis of the driving shaft.

As a far preferable pump device, in any one of the above pump devices, a length of the first communication groove in the circumferential direction of the rotation axis of the driving shaft is set to be longer than the sum of a length of the pump chamber sandwiched between the adjacent two vanes of the plurality of vanes and a thickness of the one vane.

As a far preferable pump device, in any one of the above pump devices, the pump housing has a second communication groove, wherein the second communication groove has a third end portion and a fourth end portion which are a pair of end portions in the rotation direction of the driving shaft, the third end portion is connected to a start point of the suction port, and when the rear-side vane, in the rotation direction of the driving shaft, of the adjacent two vanes of the plurality of vanes is positioned at an end point of the discharge port, the fourth end portion is positioned at a rear side in the rotation direction of the driving shaft with respect to the front-side vane in the rotation direction of the driving shaft.

As a far preferable pump device, in any one of the above pump devices, the first communication groove and the second communication groove are formed so that when any one of the plurality of vanes is located at an overlap position with the second end portion of the first communication groove, none of the plurality of vanes overlap the fourth end portion of the second communication groove.

As a far preferable pump device, in any one of the above pump devices, an entire length, in the circumferential direction of the rotation axis of the driving shaft, of the first communication groove is longer than that of the second communication groove.

As a far preferable pump device, in any one of the above pump devices, the discharge port is formed so that as the eccentric amount of the center of the inner circumference of the cam ring with respect to the rotation axis of the driving shaft becomes smaller, a timing when communication of one pump chamber of the plurality of pump chambers with the discharge port ends according to the rotation of the driving shaft becomes later.

As a far preferable pump device, in any one of the above pump devices, a sectional area of the first communication groove in a rotation axis direction of the driving shaft is set to 0.8 $mm^2$ or less throughout an entire range in the circumferential direction of the rotation axis of the driving shaft.

As a far preferable pump device, in any one of the above pump devices, the sectional area of the first communication groove in the rotation axis direction of the driving shaft is constant throughout the entire range in the circumferential direction of the rotation axis of the driving shaft in a rear-side region with respect to the front-side vane, in the rotation direction of the driving shaft, of the adjacent two vanes of the plurality of vanes when the rear-side vane, in the rotation direction of the driving shaft, of the adjacent two vanes overlaps the suction port.

As a far preferable pump device, in any one of the above pump devices, the sectional area of the first communication groove in the rotation axis direction of the driving shaft in a front-side region with respect to the front-side vane, in the rotation direction of the driving shaft, of the adjacent two vanes of the plurality of vanes is great as compared with that in a rear-side region with respect to the front-side vane when the rear-side vane, in the rotation direction of the driving shaft, of the adjacent two vanes separates from an end point of the suction port.

The invention claimed is:

1. A pump device comprising:

a driving shaft;

a pump element having a rotor, a plurality of vanes and a cam ring, wherein the rotor is driven and rotated by the driving shaft, and has a plurality of slits in a circumferential direction of a rotation axis of the driving shaft, the plurality of vanes are movably set in the respective slits, and the cam ring is formed into a ring shape, and forms a plurality of pump chambers by the rotor and the plurality of vanes; and a pump housing having therein a pump element accommodating space, a suction passage, a discharge passage, a first fluid pressure chamber, a second fluid pressure chamber and a pressure plate on which a suction port, a discharge port and a first communication groove are formed, wherein the pump element accommodating space accommodates therein the pump element, the suction port faces and opens to a suction region where volumes of the plurality of pump chambers increase according to rotation of the driving shaft, the suction passage is connected to the suction port, and supplies working fluid to the suction port according to the rotation of the driving shaft, the discharge port faces and opens to a discharge region where the volumes of the plurality of pump chambers decrease according to the rotation of the driving shaft, the discharge passage is connected to the discharge port, and discharges the working fluid from the discharge port according to the rotation of the driving shaft, the first communication groove has, as a pair of end portions thereof in a rotation direction of the driving shaft, a first end portion connected to a start point of the discharge port and a second end portion at an opposite side to the first end portion, the first communication groove is structured to communicate with the suction port by a configuration in which when a front-side vane of arbitrary adjacent two vanes of the plurality of vanes is positioned at the start point of the discharge port by the rotation of the driving shaft, the second end portion is positioned at a rear side in the rotation direction with respect to a rear-side vane of the adjacent two vanes which comes immediately after the front-side vane, the first fluid pressure chamber and the second fluid pressure chamber are provided, as a pair of spaces, at an outer side, in a radial direction of the rotation axis of the driving shaft, of the cam ring in the pump element accommodating space, and serve to move the cam ring so that an eccentric amount of a center of an inner circumference of the cam ring with respect to the rotation axis of the driving shaft is changed by a pressure difference between the first fluid pressure chamber and the second fluid pressure chamber, the first fluid pressure chamber is provided at a position where a volume of the first fluid pressure chamber decreases when the cam ring moves in a direction in which the eccentric amount of the center of the inner circumference of the cam ring with respect to the rotation axis of the driving shaft increases, and the second fluid pressure chamber is provided at a position where a volume of the second fluid pressure chamber increases when the cam ring moves in the direction in which the eccentric amount of the center of the inner circumference of the cam ring with respect to the rotation axis of the driving shaft increases.

2. The pump device as claimed in claim 1, wherein:

the cam ring has a cam profile by which when the cam ring is located at a position at which the eccentric amount of the center of the inner circumference of the cam ring with respect to the rotation axis of the driving shaft is a maximum and a rear-side vane of arbitrary adjacent two vanes of the plurality of vanes is positioned at an end point of the suction port, in a first closed region that is a region between a front-side vane of the adjacent two vanes and the end point of the suction port, a distance between an inner circumferential surface of the cam ring and the rotation axis of the driving shaft does not increase with the rotation of the driving shaft.

3. The pump device as claimed in claim 2, wherein:

the cam ring has a cam profile by which when the cam ring is located at the position at which the eccentric amount of the center of the inner circumference of the cam ring with respect to the rotation axis of the driving shaft is the maximum, in the first closed region, the distance between the inner circumferential surface of the cam ring and the rotation axis of the driving shaft decreases with the rotation of the driving shaft.

4. The pump device as claimed in claim 3, wherein:

the pump housing has a cam supporting surface that contacts an outer-side surface, in the radial direction of the rotation axis of the driving shaft, of the cam ring, and the cam ring is provided so that when the cam ring is located at the position at which the eccentric amount of the center of the inner circumference of the cam ring with respect to the rotation axis of the driving shaft is the maximum, the center of the inner circumference of the cam ring is positioned at a suction region side with respect to the rotation axis of the driving shaft in a direction of a line connecting the cam supporting surface and the rotation axis of the driving shaft when viewing a cross section of the cam ring orthogonal to the rotation axis of the driving shaft.

5. The pump device as claimed in claim 4, wherein:

the cam ring is provided so that, even in a state in which the working fluid is sucked from the suction port and discharged from the discharge port, when the cam ring is located at the position at which the eccentric amount of the center of the inner circumference of the cam ring with respect to the rotation axis of the driving shaft is the maximum, the center of the inner circumference of the cam ring is positioned at the suction region side with respect to the rotation axis of the driving shaft in the direction of the line connecting the cam supporting surface and the rotation axis of the driving shaft when viewing the cross section of the cam ring orthogonal to the rotation axis of the driving shaft.

6. The pump device as claimed in claim 4, wherein:

a distance from the center of the inner circumference of the cam ring to the inner circumference of the cam ring when viewing the cross section orthogonal to the rotation axis of the driving shaft is constant throughout an entire circumference in the circumferential direction of the rotation axis of the driving shaft.

7. The pump device as claimed in claim 3, further comprising:

a rotation stopper pin, wherein the rotation stopper pin is provided in the pump element accommodating space, and limits a relative rotation of the cam ring with respect to the pump housing in the circumferential direction of the rotation axis of the driving shaft.

8. The pump device as claimed in claim 3, wherein:

a length of the first communication groove in the circumferential direction of the rotation axis of the driving shaft is set to be longer than the sum of a length of a pump chamber sandwiched between the front-side vane positioned at the start point of the discharge port and the adjacent rear-side vane and a thickness of either one of the arbitrary adjacent two vanes.

9. The pump device as claimed in claim 1, wherein:

the pump housing has a second communication groove formed on the pressure plate, wherein the second communication groove has a third end portion and a fourth end portion which are a pair of end portions in the rotation direction of the driving shaft, the third end portion is connected to a start point of the suction port, and when the rear-side vane is positioned at an end point of the discharge port, the fourth end portion is positioned at a rear side in the rotation direction with respect to the front-side vane.

10. The pump device as claimed in claim 9, wherein:

the first communication groove and the second communication groove are formed so that when any one of the plurality of vanes is located at an overlap position with the second end portion of the first communication groove, none of the plurality of vanes overlap the fourth end portion of the second communication groove.

11. The pump device as claimed in claim 9, wherein:

an entire length, in the circumferential direction of the rotation axis of the driving shaft, of the first communication groove is longer than that of the second communication groove.

12. The pump device as claimed in claim 11, wherein:

the discharge port is formed so that as the eccentric amount of the center of the inner circumference of the cam ring with respect to the rotation axis of the driving shaft becomes smaller, a closing timing of the discharge port when communication of one pump chamber of the plurality of pump chambers with the discharge port is closed according to the rotation of the driving shaft becomes later.

13. The pump device as claimed in claim 1, wherein:

a sectional area of the first communication groove in a rotation axis direction of the driving shaft is set to 0.8 $mm^2$ or less throughout an entire range in the circumferential direction from the first end portion to the second end portion of the first communication groove.

14. The pump device as claimed in claim 13, wherein:

the sectional area of the first communication groove in the rotation axis direction of the driving shaft is constant throughout the entire range in the circumferential direction from the first end portion to the second end portion of the first communication groove in a rear-side region with respect to a front-side vane of arbitrary adjacent two vanes of the plurality of vanes when a rear-side vane of the adjacent two vanes overlaps the suction port.

15. The pump device as claimed in claim 13, wherein:

the sectional area of the first communication groove in the rotation axis direction of the driving shaft in a front-side region with respect to a front-side vane of arbitrary adjacent two vanes of the plurality of vanes is greater than that in a rear-side region with respect to the front-side vane when a rear-side vane of the adjacent two vanes separates from an end point of the suction port.

* * * * *